US010386773B2

(12) United States Patent
Makita et al.

(10) Patent No.: US 10,386,773 B2
(45) Date of Patent: Aug. 20, 2019

(54) PROJECTION ARRANGEMENT FOR BINDING DEVICE

(71) Applicant: FUJI XEROX CO., LTD., Tokyo (JP)

(72) Inventors: Takuya Makita, Kanagawa (JP); Hiroaki Awano, Kanagawa (JP); Toshiyasu Yukawa, Kanagawa (JP); Kojiro Tsutsumi, Kanagawa (JP); Katsumi Harada, Kanagawa (JP); Takashi Ogino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/697,027

(22) Filed: Sep. 6, 2017

(65) Prior Publication Data

US 2018/0275585 A1 Sep. 27, 2018

(30) Foreign Application Priority Data

Mar. 23, 2017 (JP) ..... 2017-057283

(51) Int. Cl.
*B65H 37/04* (2006.01)
*G03G 15/00* (2006.01)
*B31F 5/02* (2006.01)

(52) U.S. Cl.
CPC ..... *G03G 15/6544* (2013.01); *B31F 5/022* (2013.01); *G03G 2215/00827* (2013.01); *G03G 2215/00848* (2013.01); *G03G 2215/00852* (2013.01)

(58) Field of Classification Search
CPC ..... G03G 15/6544; G03G 15/6541; G03G 2215/00827; B42B 4/00; B42B 5/08; B42B 5/00; B65H 37/04; B65H 5/068; B65H 31/26; B65H 31/34; B65H 39/00; A01B 12/006
USPC ..... 270/58.08, 58.09; 399/410
See application file for complete search history.

(56) References Cited

U.S. PATENT DOCUMENTS

2010/0202814 A1* 8/2010 Nakamura ..... B65H 37/04 399/408
2012/0148372 A1* 6/2012 Mori ..... B42B 5/00 412/33
2014/0353900 A1* 12/2014 Abe ..... B42B 5/00 270/58.08

FOREIGN PATENT DOCUMENTS

JP 2010-274623 A 12/2010

* cited by examiner

*Primary Examiner* — Patrick H Mackey
(74) *Attorney, Agent, or Firm* — Oliff PLC

(57) ABSTRACT

A binding apparatus includes a first pressing member including a base part and multiple projections projecting from the base part, the first pressing member presses a recording media stack from one side; and a second pressing member including a base part and multiple projections projecting from the base part, the second pressing member facing the first pressing member and pressing the recording media stack from the other side. At least one of the first and second pressing members has at least one lower projection whose apex in a projecting direction closer to the base part than the apexes of the other projections are, and the lower projection is provided in the first or second pressing member that has more projections than the other, or more lower projections are provided in the first or second pressing member that has more projections than the other.

8 Claims, 10 Drawing Sheets

PROJECTION ARRANGEMENT FOR BINDING DEVICE

CROSS-REFERENCE TO RELATED APPLICATIONS

This application is based on and claims priority under 35 USC 119 from Japanese Patent Application No. 2017-057283 filed Mar. 23, 2017.

BACKGROUND

Technical Field

The present invention relates to a binding apparatus and an image forming system.

SUMMARY

According to an aspect of the invention, there is provided a binding apparatus including: a first pressing member including a base part and multiple projections projecting from the base part, the first pressing member pressing the multiple projections against one side of a recording media tack to press the recording media stack; and a second pressing member including a base part and multiple projections projecting from the base part, the second pressing member facing the first pressing member and pressing the multiple projections against the other side of the recording media stack to press the recording media stack. At least one of the first pressing member and the second pressing member has at least one lower projection whose apex in a projecting direction is closer to the base part than the apexes of the other projections are. The lower projection is provided in the first pressing member or the second pressing member that has more projections than the other, or more lower projections are provided in the first pressing member or the second pressing member that has more projections than the other.

BRIEF DESCRIPTION OF THE DRAWINGS

Exemplary embodiment of the present invention will be described in detail based on the following figures, wherein.

DETAILED DESCRIPTION

Referring to the attached drawings, an exemplary embodiment of the present invention will be described below.

Figure 1:
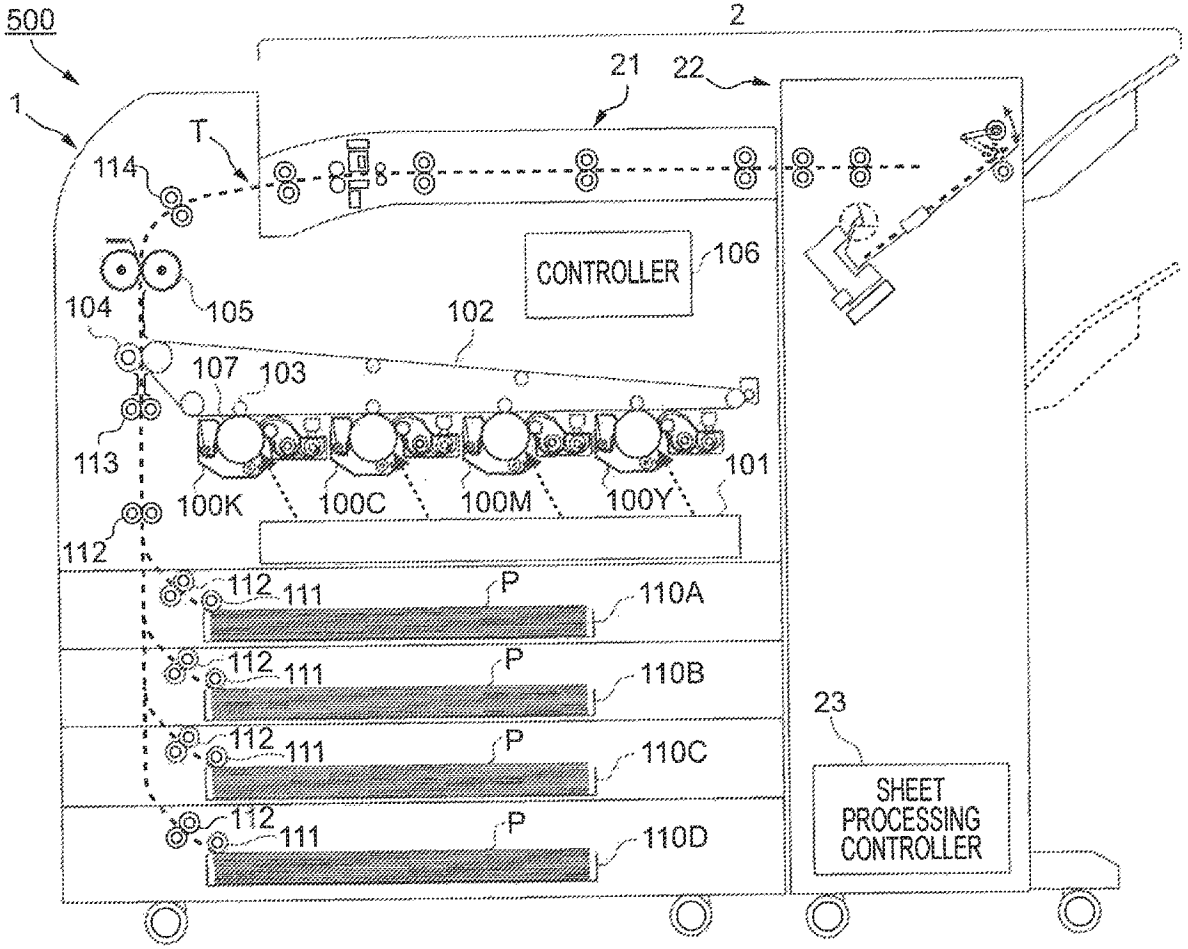
FIG. 1 shows the configuration of an image forming system to which an exemplary embodiment of the present invention is applied.

FIG. 1 shows the configuration of an image forming system 500 according to this exemplary embodiment.

The image forming system 500 shown in FIG. 1 includes an image forming apparatus 1, such as a printer or a copier, that forms a color image on a sheet P, serving as an example of a recording medium, and a post-processing apparatus 2 that performs post-processing, such as binding, on multiple sheets P (a recording media stack) on which images have been formed by the image forming apparatus 1.

The image forming apparatus 1 includes four image-forming units 100Y, 100M, 100C, and 100K (also collectively referred to as "image-forming units 100") that form images according to corresponding color image data. The image forming apparatus 1 also includes a laser exposure device 101 that irradiates photoconductor drums 107 of the image-forming units 100 with light.

The image forming apparatus 1 also includes an intermediate transfer belt 102, to which color toner images formed in the image-forming units 100 are transferred in an overlapping manner.

The image forming apparatus 1 also includes first transfer rollers 103 that sequentially transfer the color toner images formed in the image-forming units 100 to the intermediate transfer belt 102 (first transfer), second transfer rollers 104 that transfers, all at once, the color toner images transferred to the intermediate transfer belt 102 to a sheet P (second transfer), and a fixing device 105 that fixes the second-transferred color toner images to the sheet P. The image forming apparatus 1 also includes a controller 106 that includes a program-controlled central processing unit (CPU) and controls the operation of the image forming apparatus 1.

In the image-forming units 100 of the image forming apparatus 1, color toner images are formed through the process including charging the photoconductor drums 107, forming electrostatic latent images on the photoconductor drums 107 by scanning the photoconductor drums 107 with light from the laser exposure device 101, developing the thus-formed electrostatic latent images with color toners, and the like.

The color toner images formed on the image-forming units 100 are sequentially and electrostatically transferred to the intermediate transfer belt 102 by the first transfer rollers 103. Then, the color toner images are transported to the second transfer rollers 104 as the intermediate transfer belt 102 revolves.

In the image forming apparatus 1, multiple sheets P that differ in size and type are stored in sheet containers 110A to 110D.

When an image is to be formed on a sheet P, for example, the sheet P is picked up from the sheet container 110A by a pick-up roller 111 and is transported to registration rollers 113 by transport rollers 112.

Then, the registration rollers 113 feed the sheet P at the same time when the color toner images on the intermediate transfer belt 102 are transported to the second transfer rollers 104.

Then, the color toner images are electrostatically transferred (second-transferred), all at once, to the sheet P by the effect of a transfer electric field formed by the second transfer rollers 104.

Thereafter, the sheet P to which the color toner images have been second-transferred is separated from the intermediate transfer belt 102 and is transported to the fixing device 105. In the fixing device 105, the color toner images are fixed to the sheet P through fixing processing, in which heat and pressure are applied. Thus, the image is formed.

The sheet P on which the image has been formed is discharged from a sheet discharge part T of the image forming apparatus 1 by transport rollers 114 and is then fed to the post-processing apparatus 2.

The post-processing apparatus 2, serving as an example of a binding apparatus, is located downstream of the sheet discharge part T of the image forming apparatus 1 and performs post-processing, such as punching and binding, on the sheet P on which the image has been formed.

Figure 2:
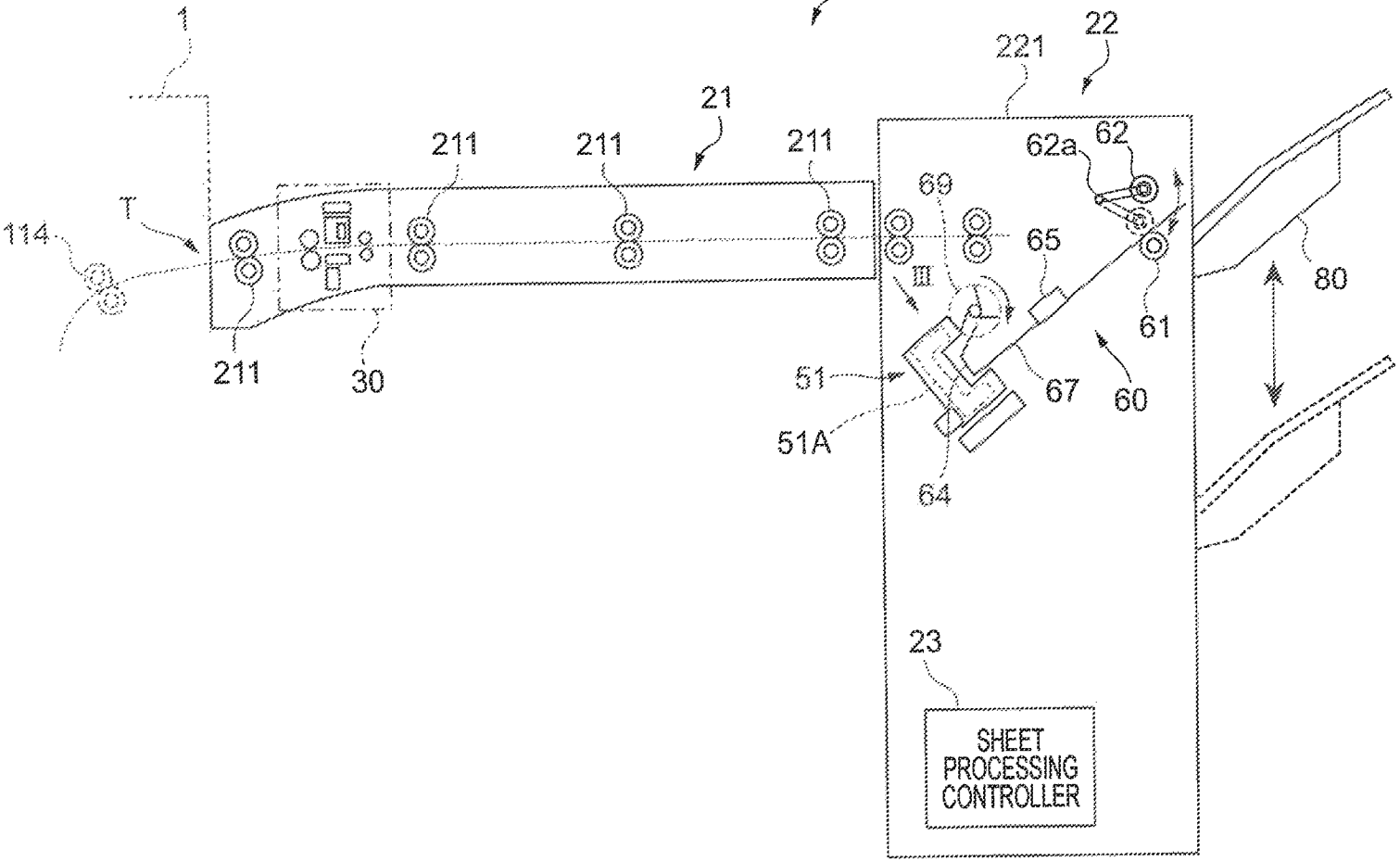
FIG. 2 shows the configuration of a post-processing apparatus.

FIG. 2 shows the configuration of the post-processing apparatus 2.

The post-processing apparatus 2 includes a transport unit 21 connected to the sheet discharge part T of the image forming apparatus 1, and a finisher unit 22 that performs predetermined processing on the sheet P transported by the transport unit 21.

The post-processing apparatus 2 also includes a sheet processing controller 23 that controls the respective mechanisms in the post-processing apparatus 2. The sheet processing controller 23 includes a program-controlled CPU. The sheet processing controller 23 is connected to the controller 106 (see FIG. 1) via a signal line (not shown) and transmits and receives control signals and other signals to and from the controller 106.

The transport unit 21 of the post-processing apparatus 2 includes a punching functional part 30 that creates (punches) two, four, or other number of holes, and transport rollers 211 that transport the sheet P, on which the image has been formed in the image forming apparatus 1, to the finisher unit 22.

The finisher unit 22 includes a finisher unit body 221, a sheet collecting part 60 that collects a necessary number of sheets P to form a sheet stack, and a binding unit 51 that binds an end of the sheet stack formed in the sheet collecting part 60 (end binding).

The finisher unit 22 includes a rotatable transport roller 61 that is used to transport the sheet stack formed in the sheet collecting part 60. The finisher unit 22 also includes a movable roller 62 that can pivot about a rotation axis 62*a* and can move between a position where it is retracted from the transport roller 61 and a position where it presses the transport roller 61.

The finisher unit 22 also includes a stacker 80, on which bound sheet stacks transported by the transport roller 61 and the movable roller 62 are stacked. The stacker 80 moves up or down according to the amount of the bound sheet stacks it supports.

When the post-processing apparatus 2 performs processing, first, a sheet P is transported from the image forming apparatus 1 into the transport unit 21 of the post-processing apparatus 2.

In the transport unit 21, the sheet P is punched by the punching functional part 30 and is then sent to the finisher unit 22 by the transport rollers 211.

When there is no punching instruction, the sheet P is sent straight to the finisher unit 22 without being punched by the punching functional part 30.

The sheet P sent to the finisher unit 22 is transported to the sheet collecting part 60. More specifically, the sheet P is transported to a position above the sheet collecting part 60 and then drops onto the sheet collecting part 60.

The sheet P is supported from below by a support plate 67 provided in the sheet collecting part 60. Then, the sheet P slides over the support plate 67 due to the inclination of the support plate 67 and the operation of a rotating paddle 69.

Then, the sheet P comes into contact with an end guide 64 attached to an end of the support plate 67, and thus, in this exemplary embodiment, the movement of the sheet P stops.

This operation is performed each time a sheet P is transported from the upstream side, and a sheet stack (a recording-medium stack) is formed on the sheet collecting part 60 with the trailing ends of the sheets P being aligned.

Furthermore, in this exemplary embodiment, aligning members 65 that are movable in a sheet-stack width direction (i.e., a direction perpendicular to the plane of the sheet of FIG. 2) are provided to adjust the widthwise position of the sheet stack.

There are two aligning members 65; one is on one side of the sheet stack, and the other is on the other side of the sheet stack in the width direction.

In this exemplary embodiment, each time a sheet P is fed to the support plate 67, the widthwise ends (i.e., the sides) of the sheets P on the support plate 67 are pushed by the aligning members 65 such that the widthwise positions of the sheets P (a sheet stack) are adjusted. Once a predetermined number of sheets P are stacked on the support plate 67, and a sheet stack is formed on the support plate 67, the binding unit 51 binds an end of the sheet stack.

The binding unit 51 includes a pressing member pair 81 (described below) that presses the sheet stack. The pressing member pair includes an upper pressing member disposed above a formed sheet stack and a lower pressing member disposed below the formed sheet stack.

In this exemplary embodiment, an advancing/retracting mechanism 51A that advances or retracts one of the upper and lower pressing members toward or from the other is provided.

In this exemplary embodiment, a sheet stack formed on the support plate 67 is located between the upper pressing member and the lower pressing member. Then, the upper and lower pressing members are pressed against the sheet stack from both sides of the sheet stack to join, by pressure, the sheets constituting the sheet stack, thereby binding the sheet stack. In other words, in this exemplary embodiment, the sheet stack is bound without staples or other metal fasteners.

Once the sheet stack is bound, the movable roller 62 moves toward the transport roller 61, and the sheet stack is nipped between the movable roller 62 and the transport roller 61. Then, the transport roller 61 and the movable roller 62 are rotated to transport the bound sheet stack to the stacker 80.

Figure 3:
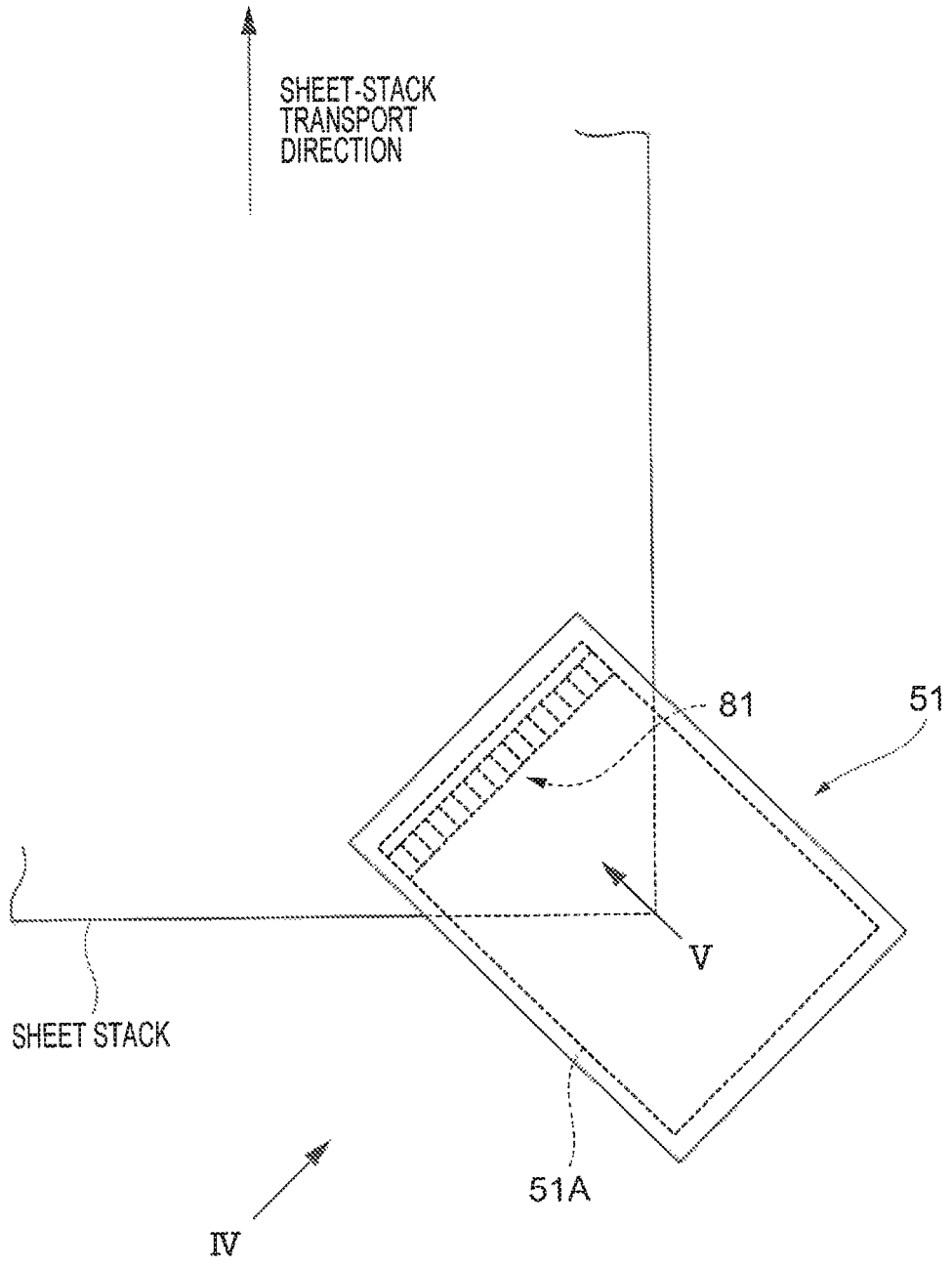
FIG. 3 shows a binding unit, as viewed in an arrow III direction in FIG. 2.

FIG. 3 shows the binding unit 51, as viewed in an arrow III direction in FIG. 2.

In this exemplary embodiment, as shown in FIG. 3, the binding unit 51 is disposed at an angle to the sheet-stack transport direction. The binding unit 51 includes the pressing member pair 81, and, in this exemplary embodiment, a sheet stack is nipped by the pressing member pair 81 to be bound.

The binding unit 51 is disposed so as to oppose a corner of the sheet stack and performs binding on the corner of the sheet stack.

In this exemplary embodiment, although an example in which the binding unit 51 is disposed so as to oppose a corner of the sheet stack is shown, the binding unit 51 may be disposed so as to oppose a side edge of the sheet stack. Alternatively, the binding unit 51 may be provided in a movable manner to bind the sheet stack at multiple positions.

Figure 4A:
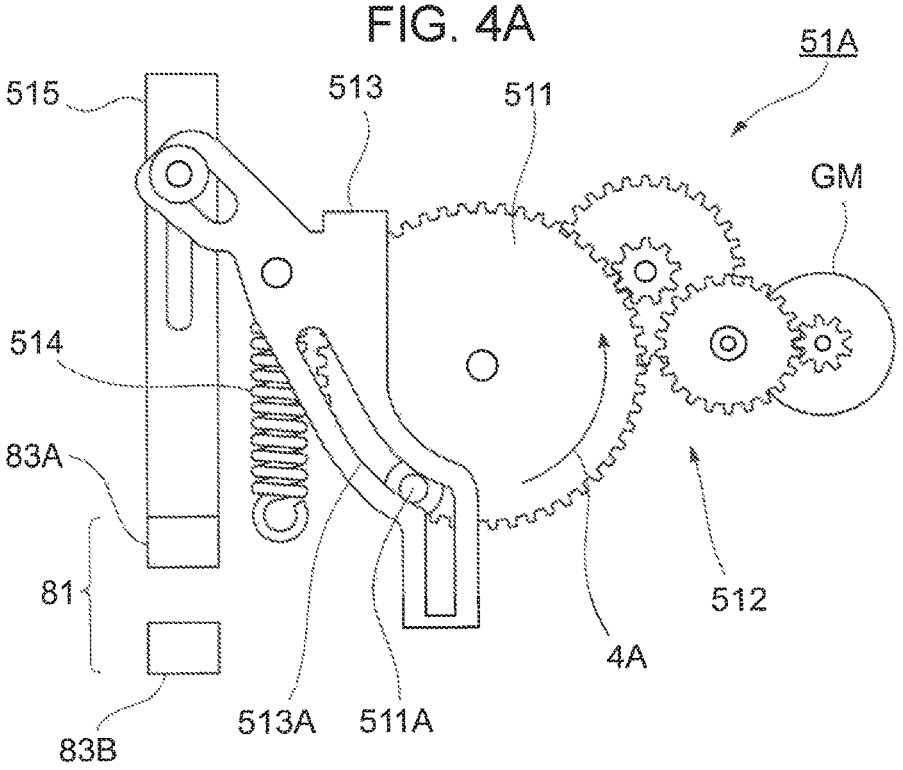
FIGS. 4A and 4B show an advancing/retracting mechanism, as viewed in an arrow IV direction in FIG. 3.
Figure 4B:
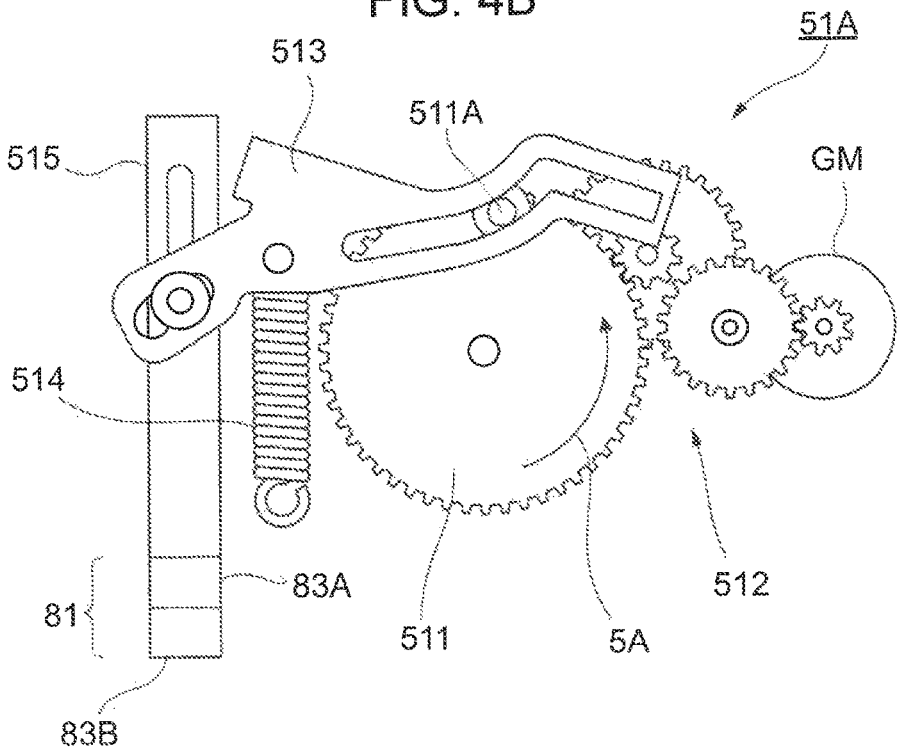

FIGS. 4A and 4B show the advancing/retracting mechanism 51A, as viewed an arrow IV direction in FIG. 3.

As shown in FIG. 4A, in this exemplary embodiment, the pressing member pair 81 that is driven by the advancing/retracting mechanism 51A to press the sheet stack is provided. The pressing member pair 81 includes an upper pressing member 83A, serving as an example of a first pressing member, and a lower pressing member 83B, serving as an example of a second pressing member. In this exemplary embodiment, the upper pressing member 83A is disposed on the upper side, and the lower pressing member 83B is disposed on the lower side. The upper pressing member 83A faces the lower pressing member 83B.

As shown in FIG. 4A, the advancing/retracting mechanism 51A includes a rotary gear 511. The advancing/retracting mechanism 51A also includes a gear motor GM for rotating the rotary gear 511, and transmission gears 512 for transmitting the rotational driving force from the gear motor GM to the rotary gear 511. The rotary gear 511 has a projection 511A on a side surface thereof.

The advancing/retracting mechanism 51A also includes a crank member 513 that pivots. The crank member 513 has an elongated hole 513A in which the projection 511A of the rotary gear 511 is positioned.

The advancing/retracting mechanism 51A also includes a spring 514 for urging the crank member 513 downward, and an advancing/retracting member 515 that is attached to the left end of the crank member 513 (in FIGS. 5A and 5B) and that moves up and down. In this exemplary embodiment, the upper pressing member 83A is attached to the lower end of the advancing/retracting member 515.

FIG. 4A shows a state in which the advancing/retracting member 515 has moved upward, and the upper pressing member 83A has retracted from the lower pressing member 83B.

When binding is performed, the gear motor GM is driven, rotating the rotary gear 511 in an arrow 4A direction in. FIG. 4A. As a result, the rotary gear 511 and other members are in the state shown in FIG. 4B.

In the state shown in FIG. 4B, the projection 511A of the rotary gear 511 is positioned on the upper side, and the right end (in FIG. 4B) of the crank member 513 is lifted upward.

Furthermore, the crank member 513 is pulled downward by the spring 514, and the advancing/retracting member 515 is moved downward. As a result, the upper pressing member 83A is pressed against the sheet stack (not shown in FIGS. 4A and 4B).

In this case, the sheet stack is nipped between the upper pressing member 83A and the lower pressing member 83B, and thus, the sheets constituting the sheet stack are joined together by pressure.

In this exemplary embodiment, the upper pressing member 83A is moved by the crank member 513. However, this is merely an example, and the upper pressing member 83A may be moved by pressing a noncircular cam against the upper pressing member 83A or a portion that moves in conjunction with the upper pressing member 83A.

In this exemplary embodiment, the upper pressing member 83A is advanced toward and retracted from the lower pressing member 83B. However, the lower pressing member 83B or both the upper pressing member 83A and the lower pressing member 83B may be advanced and retracted.

Figure 5A:
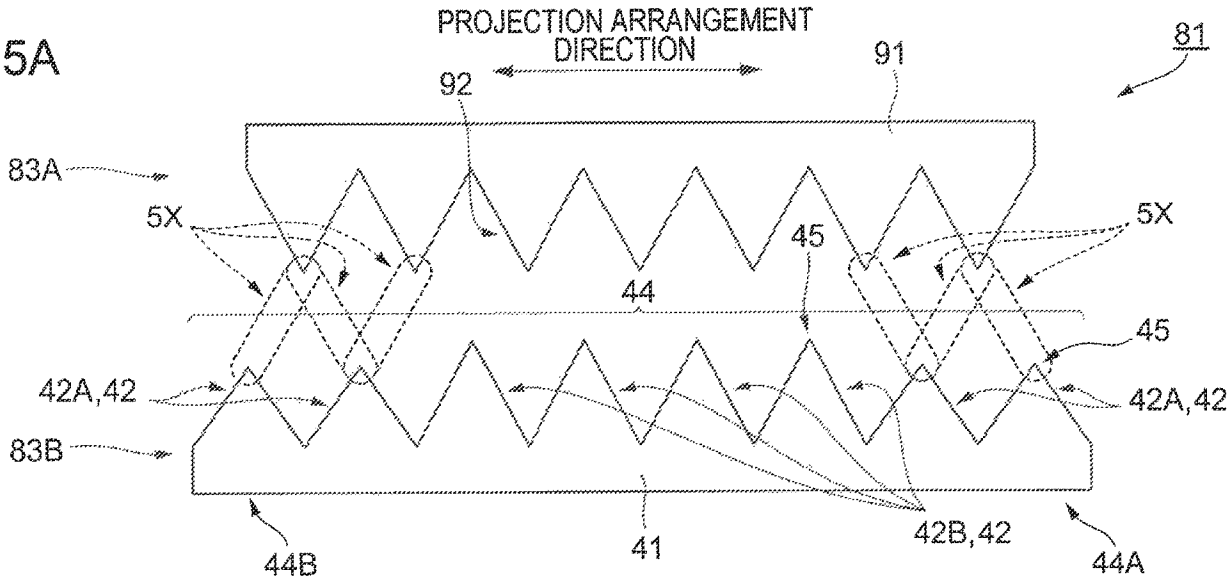
FIGS. 5A and 5B show a pressing member pair, as viewed in an arrow V direction in FIG. 3.
Figure 5B:
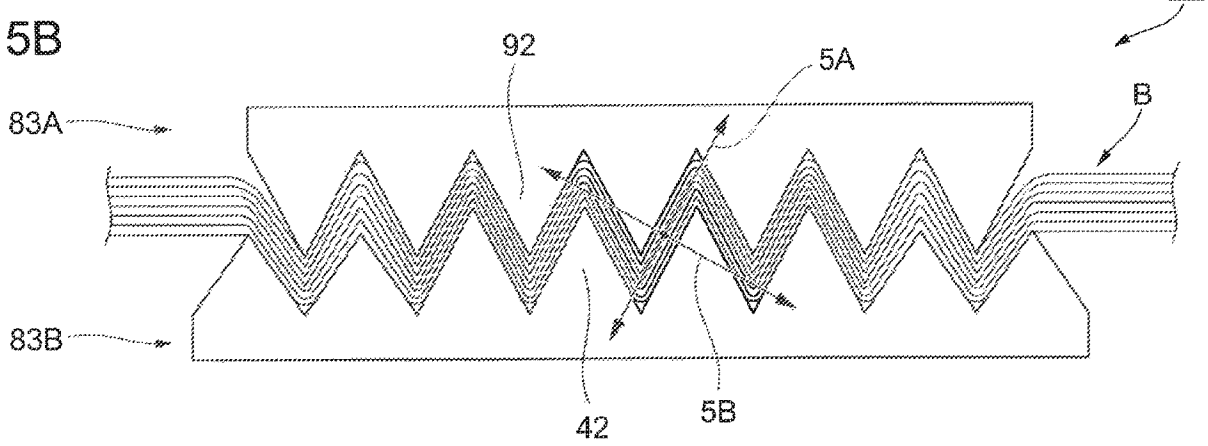

FIGS. 5A and 5B show the pressing member pair 81, as viewed in an arrow V direction in FIG. 3.

As shown in FIG. 5A, the pressing member pair 81 includes the upper pressing member 83A and the lower pressing member 83B.

The lower pressing member 83B includes a base part 41 extending in the left-right direction in FIG. 5A. The lower pressing member 83B also includes multiple projections 42 that project upward from the base part 41 and are arranged side-by-side in the left-right direction in FIG. 5A. The multiple projections 42 that are arranged side-by-side in one direction (i.e., the longitudinal direction of the lower pressing member 83B; hereinbelow, "projection arrangement direction") form projection row 44.

The projection row 44 (multiple projections 42) includes lower projections 42A, which have a small height, and higher projections 42B, which have a large height.

The amount by which the lower projections 42A project from the base part 41 is smaller than the amount by which the higher projections 42B project from the base part. In other words, the lower projections 42A and the higher projections 42B have apexes 45 at their ends in the projecting direction, and the apexes 45 of the lower projections 42A are closer to the base part 41 than the apexes 45 of the higher projections 42B are.

In this exemplary embodiment, the lower projections 42A are provided at the ends of the projection row 44 in the projection arrangement direction. Multiple lower projections 4A are provided at each end of the projection row 44.

In other words, the projection row 44 has one end 44A and the other end 44B at different positions in the projection arrangement direction, and multiple (in this exemplary embodiment, two) lower projections 42A are provided at each of the one end 44A and the other end 44B.

More specifically, in this exemplary embodiment, multiple lower projections 42A are provided at both ends of the projection row 44 in the projection arrangement direction.

In this exemplary embodiment, among the projections 42 in the projection row 44, the projections 42 located on the extreme ends in the projection arrangement direction are the lower projections 42A.

More specifically, in this exemplary embodiment, among the multiple projections 42 provided in the lower pressing member 83B, at least the projection 42 located on the extreme left side and the projection 42 located on the extreme right side are the lower projections 42A.

Next, the upper pressing member 83A will be described.

The upper pressing member 83A also includes a base part 91 extending in the left-right direction in FIG. 5A. The upper pressing member 83A also includes multiple projections 92 projecting downward from the base part 91. The amount by which the multiple projections 92 project from the base part 91 is equal to the amount by which the higher projections 42B project from the base part 41.

In other words, in this exemplary embodiment, the amount by which the projections 92 provided in the upper pressing member 83A project from the base part 91 is equal to the amount by which the higher projections 42B provided in the lower pressing member 83B project from the base part 41.

In this exemplary embodiment, when a sheet stack is bound, the upper pressing member 83A is advanced. (lowered) toward the lower pressing member 83B with the sheet stack (not shown in FIG. 5A) disposed therebetween.

As a result, the upper pressing member 83A (more specifically, the projections 92 provided in the upper pressing member 83A) is pressed against one side of the sheet stack, and the lower pressing member 83B (more specifically, the projections 42 provided in the lower pressing member 83B) is pressed against the other side of the sheet stack.

When the upper pressing member 83A is further advanced, the upper pressing member 83A and the lower pressing member 83B approach each other even more closely, and, as shown in FIG. 58, the sheet stack B is pressed (nipped) between upper pressing member 83A and the lower pressing member 83B.

In this state, the projections 92 of the upper pressing member 83A mesh with the corresponding spaces between the projections 42 of the lower pressing member 83B. Thereafter, in this exemplary embodiment, the upper pressing member 83A retracts from the sheet stack B.

Through this process, binding on the sheet stack B is completed.

In this exemplary embodiment, when the sheet stack B is pressed by the upper pressing member 83A and the lower pressing member 83B, the sheet stack B is elongated in the direction indicated by reference sign 5A in FIG. 5B (i.e., the direction perpendicular to the thickness direction of the sheet stack B). As a result, in each sheet in the sheet stack B, the fibers constituting the sheet are elongated, and spaces between the fibers are expanded.

Furthermore, during binding, a pressure in the direction indicated by reference sign 5B (i.e., the thickness direction of the sheet stack B) is applied to the sheet stack B. As a result, the fibers of a first sheet constituting the sheet stack B enter expanded spaces between the fibers of a second sheet next to the sheet.

Thereafter, the pressure applied to the sheet stack B is removed. This allows the fibers constituting the first sheet to be entangled with the fibers constituting the second sheet, and thus, the sheets in the sheet stack B are joined together.

The projections have suitable heights and pitches according to the thickness of the sheet stack B. More specifically, it is desirable that the larger the thickness of the sheet stack. B is, the greater the size and pitch of the projections are, and, the smaller the thickness of the sheet stack B is, the smaller the size and pitch of the projections are.

In this exemplary embodiment, as shown in FIG. 5A, the lower pressing member 83B has the higher projections 42B suitable for a thick sheet stack B, and the lower projections 42A suitable for a thin sheet stack B. Hence, whether the sheet stack B is thick or thin, the sheet stack B can be bound.

In this exemplary embodiment, as shown in FIG. 5A, the lower projections 42A are provided in the lower pressing member 83B, which has more projections than the upper pressing member 83A.

More specifically, in this exemplary embodiment, the upper pressing member 83A has seven projections 92, and the lower pressing member 83B has eight projections 42, and the lower projections 42A are provided in the lower pressing member 83B, which has more projections than the upper pressing member 83A.

When the lower projections 42A are provided in the pressing members that perform binding, the binding performance for thick sheet stacks B may decrease due to the lower projections 42A.

In contrast, as in this exemplary embodiment, by providing the lower projections 42A in the pressing member that has more projections than the other, the influence of the lower projections 42A is relatively smaller than that in the case where the lower projections 42A are provided in the pressing member having fewer projections than the other, and thus, a decline in binding performance for thick sheet stacks B can be suppressed.

Figure 6:
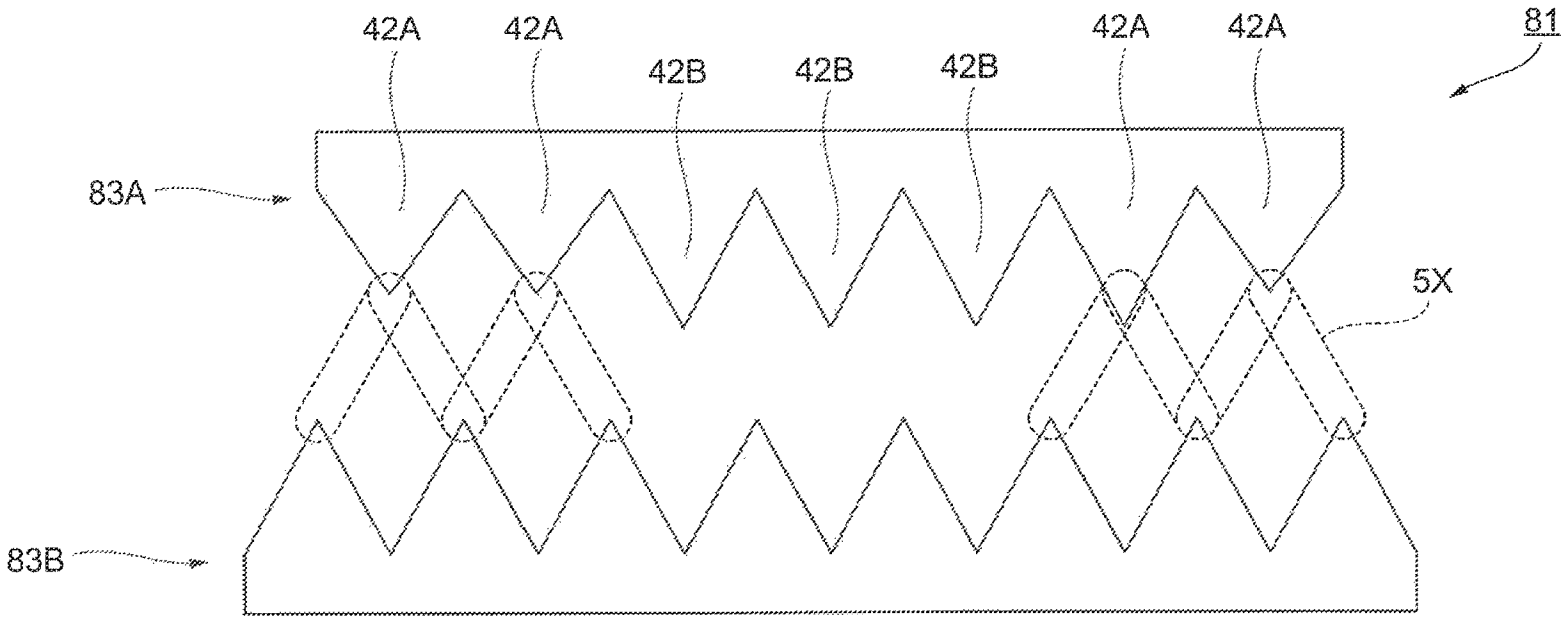
FIG. 6 shows an upper pressing member and a lower pressing member according to a comparative example.

FIG. 6 shows the upper pressing member 83A and the lower pressing member 83B according to a comparative example.

In this comparative example, the lower projections 42A are provided in the upper pressing member 83A, which has fewer projections than the lower pressing member 83B. In this comparative example, the upper pressing member 83A has three higher projections 42B, and the binding performance for thick sheet stacks B tends to be lower than that in this exemplary embodiment (the exemplary embodiment shown in FIG. 5A).

In contrast, in the exemplary embodiment shown in FIG. 5A, the lower pressing member 83B having the lower projections 42A has four higher projections 42B, and the binding performance for thick sheet stacks B is higher than that in the comparative example shown in FIG. 6.

Furthermore, as in this exemplary embodiment (as in the exemplary embodiment shown in FIG. 5A), by providing the lower projections 42A at the ends of the projection row 44, creases that may be formed in the sheet stack B are reduced.

When binding is performed by pressing two pressing members having projections against a sheet stack B, creases are likely to be formed around a portion of the sheet stack B against which the pressing members are pressed.

In contrast, as in this exemplary embodiment, by providing the lower projections 42A at the ends of the projection row 44, creases are less likely to be formed in the sheet stack B than in the case where the higher projections 42B are provided at the ends of the projection row 44.

In this exemplary embodiment, as shown in FIG. 5A, multiple (in this exemplary embodiment, two) lower projections 42A are provided at each end of the projection row 44.

In this case, creases are even less likely to be formed in the sheet stack B than in the case where a single lower projection 42A is provided at each end of the projection row 44.

In this exemplary embodiment, as shown in FIG. 5A, the lower projections 42A are provided at both ends of the projection row 44 in the projection arrangement direction. In this case, creases are less likely to be formed in the sheet stack B than in the case where the lower projections 42A are provided at only one end of the projection row 44.

When the lower projections 42A are provided at only one end of the projection row 44, creases are likely to be formed around a portion of the sheet stack B to which the other end of the projection row 44 comes into contact.

Furthermore, as in this exemplary embodiment, by providing the lower projections 42A at the ends of the projection row 44 of the lower pressing member 83B, which has more projections than the upper pressing member 83A, the pressing members are unlikely to move (shift) in the projection arrangement direction (longitudinal direction of the pressing member).

In other words, when the projections located at the extreme ends, among the multiple projections provided in the pressing member that has more projections, are the lower projections 42A, the pressing members are unlikely to move (shift) in the projection arrangement direction.

In this case, a decline in binding performance and damage to the sheet stack B due to the movement of the pressing members are unlikely to occur.

As in this exemplary embodiment, by providing the lower projections 42A, the upper pressing member 83A, which is the pressing member that moves, easily moves in the projection arrangement direction when the upper pressing member 83A advances toward the lower pressing member 83B.

In this case, the pressure applied to the sheet stack B may partially drop, leading to a decline in binding performance, or a portion of the sheet stack B may be excessively pressed, leading to damage to this portion.

More specifically, in the configuration in this exemplary embodiment, when a thick sheet stack B, which has high rigidity, is to be bound, a portion of the sheet stack B facing the lower projections 42A is unlikely to be deformed.

More specifically, because the lower projections 42A are designed for sheet stacks B having low rigidity, such as thin sheet stacks B, when a thick sheet stack B is to be bound, the sheet stack B is unlikely to be deformed when the lower projections 42A are pressed against the sheet stack B. In this case, the portion of the sheet stack B facing the lower projections 42A is likely to maintain a flat state.

Figure 7:
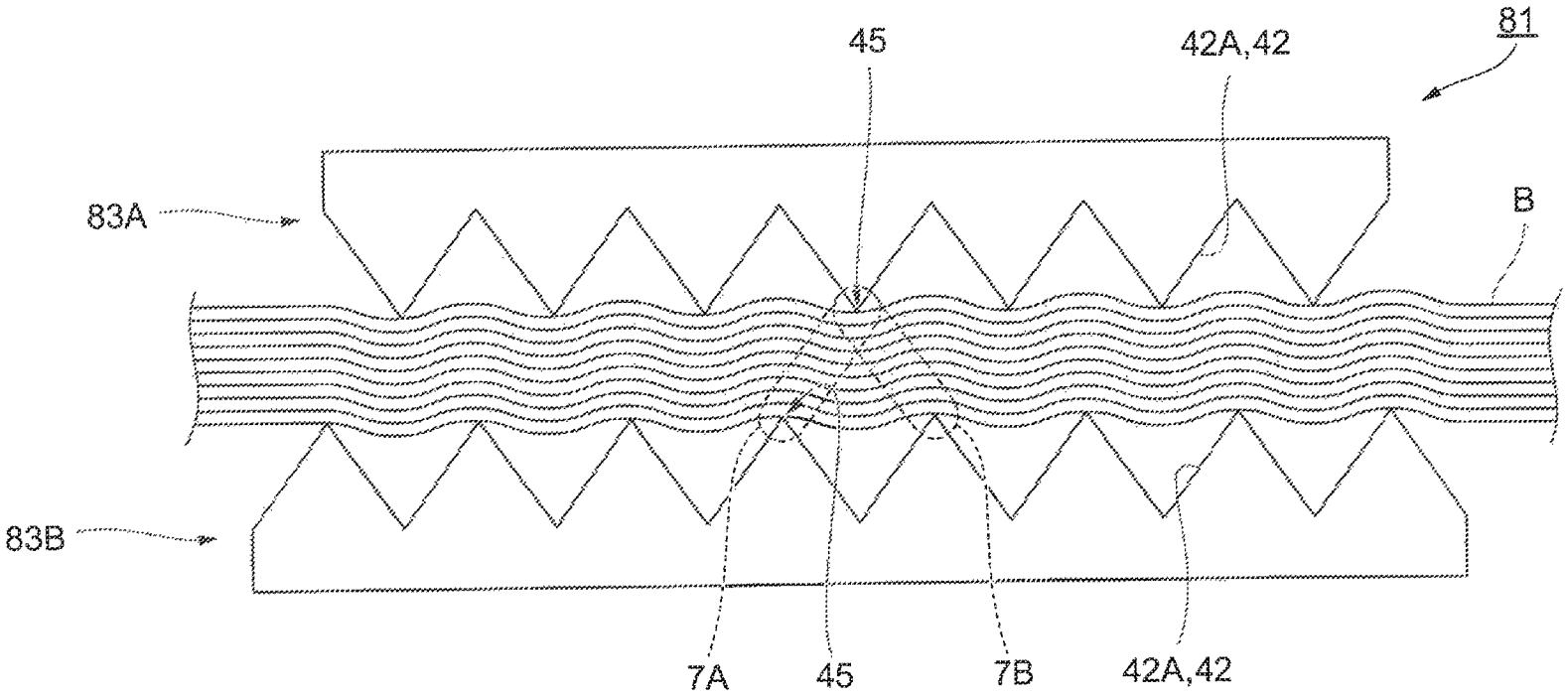
FIG. 7 shows a state of a thick sheet stack against which lower projections are pressed.

FIG. 7 shows a state of a thick sheet stack B against the lower projections 42A are pressed. In FIG. 7, all the projections 42 provided in the upper pressing member 83A and the lower pressing member 83B are the lower projections 42A.

When the lower projections 42A are pressed against the thick sheet stack B, as described above, the sheet stack B is unlikely to be deformed, and, as shown in FIG. 7, the sheet stack B is likely to maintain a flat state.

In this case, large compressive forces act in portions of the sheet stack B indicated by reference signs 7A and 7B in FIG. 7, and the sheet stack B is easily torn at these portions.

More specifically, in the sheet stack B, large compressive forces act on the lines connecting the apexes 45 of the lower projections 42A of the lower pressing member 83B and the apexes 45 of the lower projections 42A of the upper pressing member 83A, and the sheet stack B is easily torn.

When the sheet stack B is torn, torn parts that are inclined with respect to the thickness direction of the sheet stack B are formed in the sheet stack B. In other words, the torn parts, where the sheets P do not exist, are formed at the portions indicated by reference signs 7A and 7B.

When the inclined torn parts are formed, the lower projections 42A of e upper pressing member 83A advancing downward enter the inside of these torn parts.

In this case, the lower projections 42A are guided by the torn parts, and thus, the upper pressing member 83A moves obliquely, not vertically, downward. In other words, the upper pressing member 83A is shifted in the longitudinal direction of the upper pressing member 83A.

In this case, the gaps between the lower projections 42A of the upper pressing member 83A and the lower projections 42A of the lower pressing member 83B are larger or smaller than predetermined gaps. In this case, at portions where the gaps are large, the pressure applied to the sheet stack B is low, and thus, the sheet joining force is low, whereas, at portions where the gaps are small, the pressure is high, and thus, the sheet stack B is easily damaged.

Figure 8:
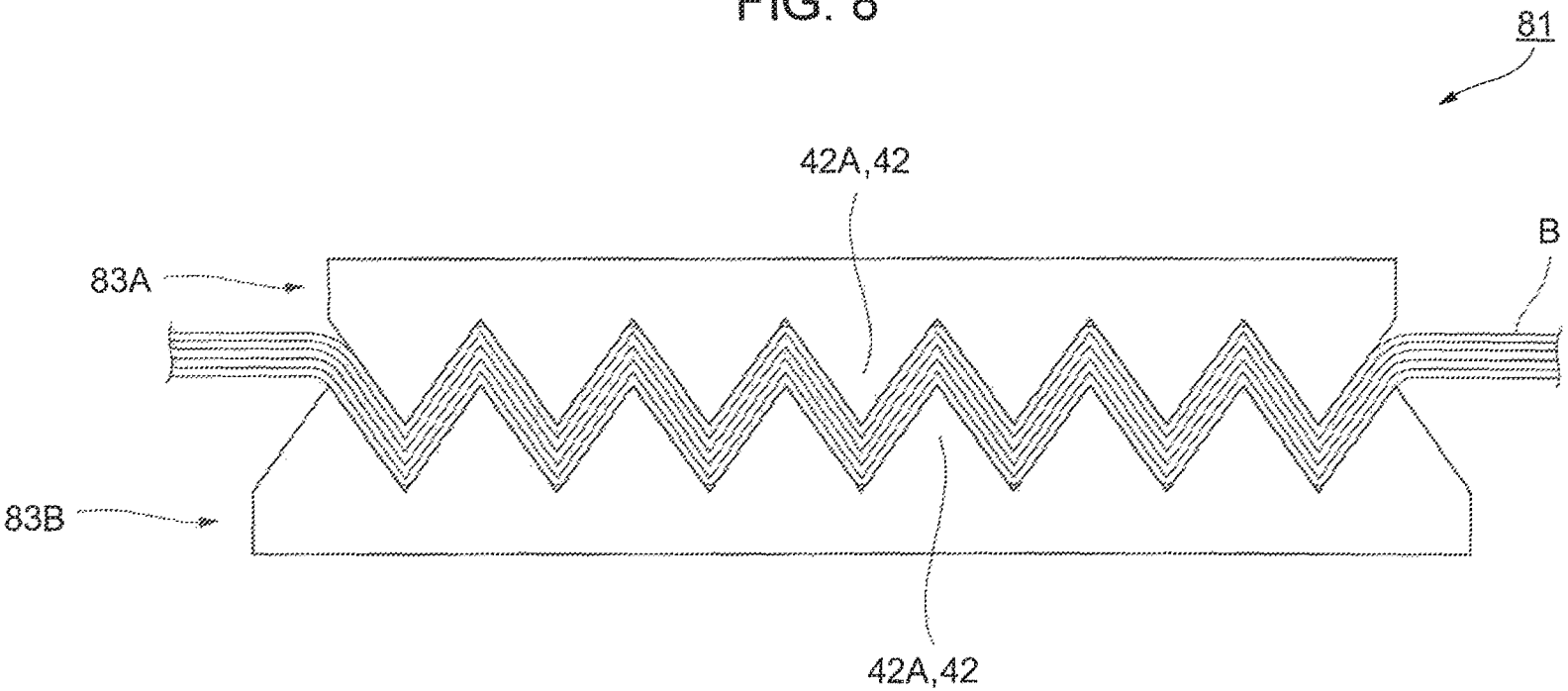
FIG. 8 shows a state of a thin sheet stack against which the lower projections are pressed.

More specifically, as shown in FIG. 8, which shows a state of the thin sheet stack B against which the lower projections 42A are pressed, when the sheet stack B is thin, the sheet stack B has low rigidity, and thus, the sheet stack B is likely to be deformed according to the surface shape of the lower projections 42A.

In this case, the contact area between the lower projections 42A and the sheet stack B is large, and thus, the sheet stack B is unlikely to be torn.

In contrast, when the sheet stack B is thick, as described above, the load is locally applied to a portion of the sheet stack B, and the sheet stack B is likely to be torn. When the sheet stack B is torn, the upper pressing member 83A moves in the longitudinal direction of the upper pressing member 83A, leading to a decline in binding performance and damage to the sheet stack B.

In this exemplary embodiment, as shown in FIG. 5A, the lower projections 42A are provided at extreme ends, in the longitudinal direction, of the projection row 44 of the lower pressing member 33B, which has more projections than the upper pressing member 83A. With this configuration, the number of potential tearing parts (described below) is reduced, and thus, the possibility of tearing in the sheet stack B is reduced.

In the configuration example as shown in FIG. 5A, the sheet stack B is likely to be torn at portions indicated by dashed lines 5X (hereinbelow, "potential tearing parts 5X"). In this exemplary embodiment, there are six potential tearing parts 5X.

In contrast, in the comparative example shown in FIG. 6, there are eight potential tearing parts 5X.

In the comparative example, the number of portions at which the sheet stack B can be torn is larger than that in this exemplary embodiment, in which there are six potential tearing parts 5X. In this case, the possibility of shifting of the upper pressing member 83A is higher than that in this exemplary embodiment, and thus, a decline in binding performance and damage to the sheet stack B may occur.

Figure 9:
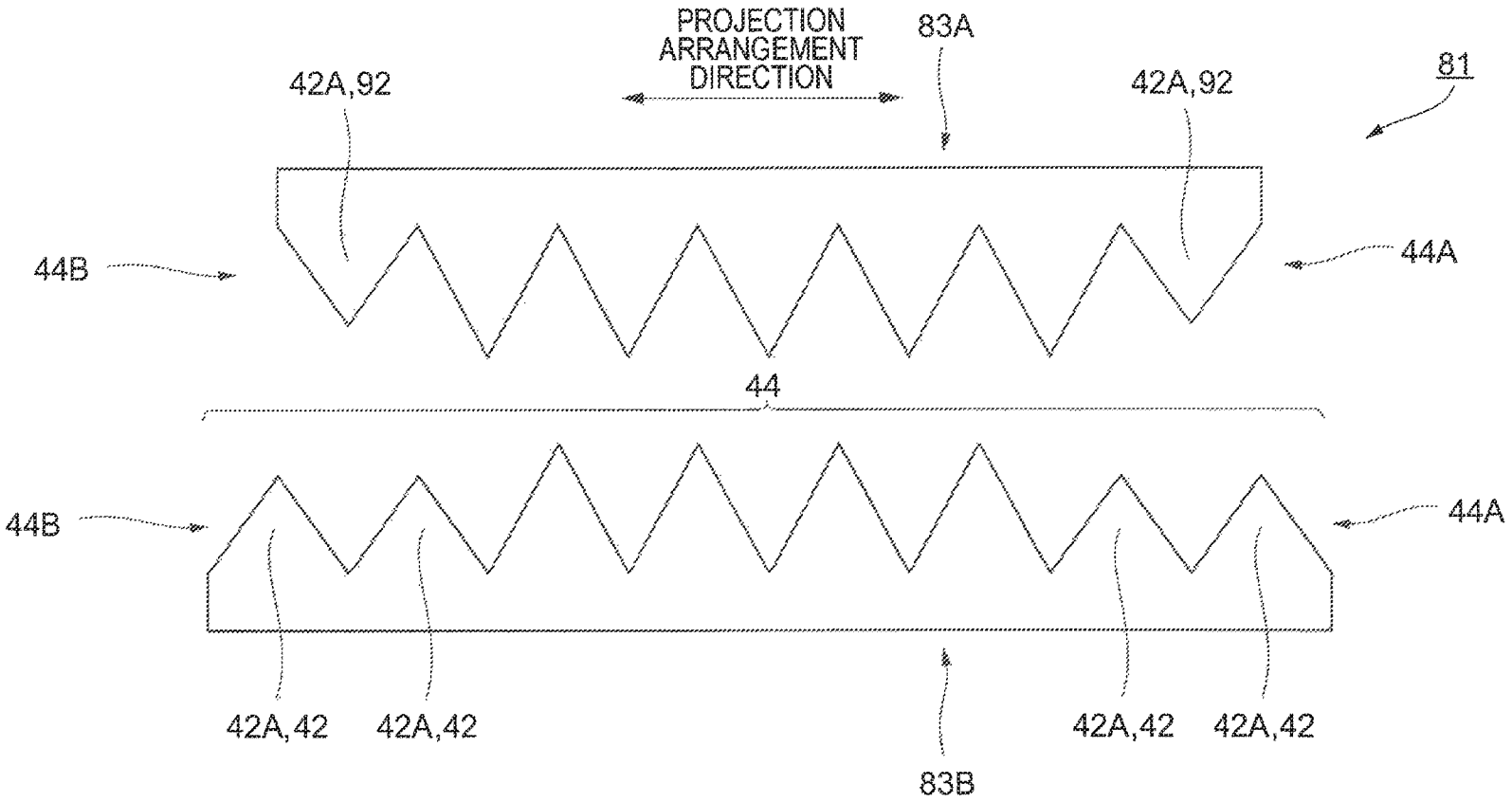
FIG. 9 shows another configuration example of the pressing member pair.

Although an example configuration in which the lower projections 42A are provided only in the lower pressing member 83B has been described, as shown in FIG. 9, which shows another configuration example of the pressing member pair 81, the lower projections 42A may be provided on both the upper pressing member 83A and the lower pressing member 83B.

When the lower projections 42A are provided in both the upper pressing member 83A and the lower pressing member 83B, the binding performance for thin sheet stacks B is higher than that in the case where the lower projections 42A are provided only in one of the pressing members.

Also in the configuration example shown it FIG. 9, similarly to the above, more lower projections 42A are provided in the lower pressing member 83B, which has more projections than the upper pressing member 83A. Thus, similarly to the above, a decline in binding performance due to the lower projections 42A (a decline in binding performance for thick sheet stacks B) can be suppressed.

Also in this configuration example, similarly to the above, more lower projections 42A are provided in the lower pressing member 83B, which has more projections than the upper pressing member 83A, at extreme ends of the projection row 44 in the longitudinal direction. With this configuration, similarly to the above, a decline in binding performance and damage to the sheet stack B due to shifting of the upper pressing member 83A are less likely to occur.

In the configuration example shown in FIG. 9, the lower projections 42A are provided at the ends, in the projection arrangement direction, of the upper pressing member 83A and the ends, in the projection arrangement direction, of the lower pressing member 83B that face each other.

More specifically, the upper pressing member 83A and the lower pressing member 83B each have the one end 44A and the other end 44B, and, in this exemplary embodiment, the one end 44A of the upper pressing member 83A and the one end 44A of the lower pressing member 83B face each other. Furthermore, the other end 44B of the upper pressing member 83A and the other end 44B of the lower pressing member 83B face each other.

In this configuration example, the lower projections 42A are provided at the one end 44A of the upper pressing member 83A and the one end 44A of the lower pressing member 83B, which face each other.

The lower projections 42A are also provided at the other end 44B of the upper pressing member 83A and the other end 44B of the lower pressing member 83B, which face each other.

In the configuration example as shown in FIG. 9, when the lower projections 42A are provided in both the upper pressing member 83A and the lower pressing member 83B, as described above, the lower projections 42A are provided at the ends of the upper pressing member 83A and the ends of the lower pressing member 83B that face each other.

In this case, creases formed in the sheet stack B are fewer than in the case where the lower projections 42A are provided in only one of the ends of the upper pressing member 83A and the ends of the lower pressing member 83B facing the ends of the upper pressing member 83A.

In the configuration example as shown in FIG. 9, when the lower projections 42A are provided in both the upper pressing member 83A and the lower pressing member 83B, the lower projections 42A are provided at both ends of the upper pressing member 83A and both ends of the lower pressing member 83B.

Also in this configuration example, as described above, more lower projections 42A are provided in the lower pressing member 83B, which has more projections than the upper pressing member 83A, and the lower projections 42A are provided at the extreme ends of the projection row 44 of the lower pressing member 83B.

Figure 10A:
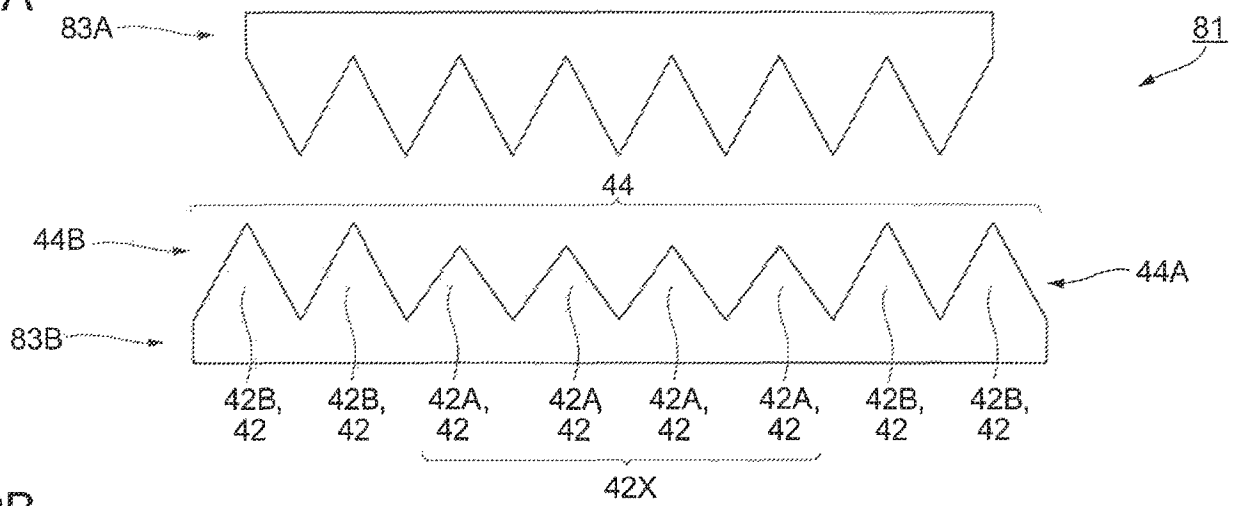
FIGS. 10A and 10B show another configuration example of the pressing member pair.
Figure 10B:
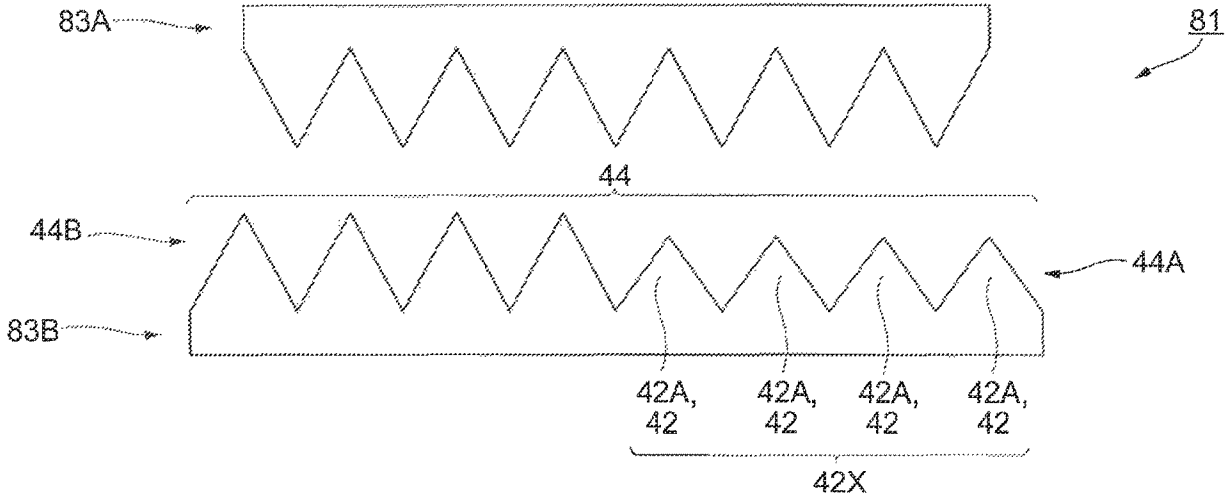

FIGS. 10A and 10B show another configuration example of the pressing member pair 81.

In the configuration example shown in FIG. 10A, the lower projections 42A are provided between the one end 44A and the other end 44B of the projection row 44 of the lower pressing member 83B.

In this configuration example, a lower projection group 42X having multiple lower projections 42A arranged side-by-side is provided in the middle of the lower pressing member 83B in the longitudinal direction. Also in this configuration example, similarly to the above, the lower projections 42A are provided in the lower pressing member 83B, which has more projections than the upper pressing member 83A.

As in this exemplary embodiment, when the lower projections 42A are provided between the one end 44A and the other end 44B of the projection row 44 (i.e., between one end and the other end of the lower pressing member 83B in the longitudinal direction), the bound sheet stack B is less likely to be unbound than in the case where the lower projections 42A are provided at the ends of the projection row 44.

In other words, when the lower projections 42A are provided between the one end 44A and the other end 44B of the projection row 44, the higher projections 42B, which are higher than the lower projections 42A, are provided at the one end 44A and the other end 44B of the projection row 44.

In this case, the binding pressure is high at ends of the bound portion of the sheet stack B, and the sheet stack B is less likely to be unbound than in the case where the binding pressure at the ends of the bound portion is small.

FIG. 10B shows another configuration example of the upper pressing member 83A and the lower pressing member 83B.

In this configuration example, the lower projections 42A are provided only at the one end 44A of the projection row 44 of the lower pressing member 83B. In this configuration example, the multiple lower projections 42A are provided, in a gathered manner, at the one end 44A of the projection row 44 of the lower pressing member 83B.

Also in this configuration example, similarly to the above, the lower projections 42A are provided in the lower pressing member 83B, which has more projections than the upper pressing member 83A, and the projections 42 located at an extreme end of the projection row 44 are the lower projections 42A.

As in the configuration example shown in FIG. 10B, even when the lower projections 42A are provided only at the one end 44A of the projection row 44, a decline in binding performance and damage to the sheet stack B due to shifting of the upper pressing member 83A can be suppressed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding apparatus comprising:

a first pressing member including a base part and a plurality of projections projecting from the base part, the first pressing member pressing the plurality of projections against one side of a recording media stack; and a second pressing member including a base part and a plurality of projections projecting from the base part, the second pressing member facing the first pressing member and pressing the plurality of projections against the other side of the recording media stack, wherein:

at least one of the first pressing member and the second pressing member has at least one lower projection that has an apex in a projecting direction that is closer to the base part than apexes of the remaining of the plurality of projections, and the lower projection is provided in either one of the first pressing member or the second pressing member, the pressing member with the lower projection having more projections than the other pressing member, the pressing member with the lower projection having a projection row in which the plurality of projections of the respective pressing member are arranged side-by-side in one direction, the lower projection being included in a plurality of lower projections that are provided at an end of the projection row in the one direction.

2. The binding apparatus according to claim 1, wherein the lower projection is provided at each end of the projection row in the one direction.

3. The binding apparatus according to claim 1, wherein the projection located at an extreme end of the projection row in the one direction is the lower projection.

4. The binding apparatus according to claim 1, wherein the lower projection is provided on each of the first pressing member and the second pressing member.

5. The binding apparatus according to claim 4, wherein the lower projection is provided at an end of the first pressing member and an end of the second pressing member that face each other.

6. An image forming system comprising:

an image forming apparatus that forms an image on a recording medium; and the binding apparatus according to claim 1, the binding apparatus binding a plurality of recording media having images formed thereon by the image forming apparatus.

7. A binding apparatus comprising:

a first pressing member including a base part and a plurality of projections projecting from the base part, the first pressing member pressing the plurality of projections against one side of a recording media stack; and a second pressing member including a base part and a plurality of projections projecting from the base part, the second pressing member facing the first pressing member and pressing the plurality of projections against the other side of the recording media stack, wherein:

at least one of the first pressing member and the second pressing member has at least one lower projection that has an apex in a projecting direction that is closer to the base part than apexes of the remaining of the plurality of projections, the lower projection is provided in either one of the first pressing member or the second pressing member, the pressing member with the lower projection having more projections than the other pressing member, the pressing member having the lower projection has a projection row in which the projections are arranged side-by-side in one direction, and the lower projection is provided between a first end and a second end of the projection row in the one direction.

8. The binding apparatus according to claim 7, further comprising a plurality of the lower projections provided between the first end and the second end of the projection row.

* * * * *